US010450940B2

(12) United States Patent
Scavone et al.

(10) Patent No.: US 10,450,940 B2
(45) Date of Patent: Oct. 22, 2019

(54) COOLANT CONTROL SYSTEMS AND METHODS TO PREVENT OVER TEMPERATURE

(71) Applicant: GM Global Technology Operations LLC, Detroit, MI (US)

(72) Inventors: Luca Scavone, Moncalieri (IT); Luigi Russiello, Collegno (IT); Andrea Lorena Torres Cuadros, Turin (IT); Andrei Gheorghi Kanev, Leini (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 182 days.

(21) Appl. No.: 15/493,640

(22) Filed: Apr. 21, 2017

(65) Prior Publication Data

US 2018/0306097 A1 Oct. 25, 2018

(51) Int. Cl.

*F01P 7/16* (2006.01)
*F01P 3/02* (2006.01)
*F01P 7/14* (2006.01)

(52) U.S. Cl.

CPC ..... *F01P 7/16* (2013.01); *F01P 3/02* (2013.01); *F01P 2007/146* (2013.01); *F01P 2025/33* (2013.01)

(58) Field of Classification Search

CPC ..... F01P 7/16; F01P 3/02; F01P 2003/027; F01P 2025/31; F01P 2025/33

USPC ..... 123/41.1

See application file for complete search history.

(56) References Cited

U.S. PATENT DOCUMENTS

2013/0255605 A1* 10/2013 Jentz ..... F01P 11/16 123/41.15
2014/0000536 A1* 1/2014 Glassford ..... F01P 3/20 123/41.08
2014/0352636 A1* 12/2014 Glassford ..... F01P 3/12 123/41.08
2015/0080179 A1* 3/2015 Gonze ..... F16H 57/0413 477/98

* cited by examiner

*Primary Examiner* — Joseph J Dallo
*Assistant Examiner* — Yi-Kai Wang

(57) ABSTRACT

A coolant control system of a vehicle includes an opening module configured to determine a coolant valve (CV) opening, a flow control valve (FCV) opening, and a block valve (BV) opening based on at least one of a block temperature difference, a head temperature difference, and a coolant outlet temperature difference. A CV control module is configured to selectively actuate a CV based on the CV opening. The CV regulates coolant flow from the FCV to a radiator and a coolant channel bypassing the radiator. A BV control module is configured to selectively actuate a BV based on the BV opening. The BV regulates coolant flow from the engine block to the FCV. A FCV control module is configured to selectively actuate a FCV based on the FCV opening. The FCV regulates coolant flow from the cylinder head and the BV to the CV.

20 Claims, 4 Drawing Sheets

COOLANT CONTROL SYSTEMS AND METHODS TO PREVENT OVER TEMPERATURE

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to vehicles with internal combustion engines and more particularly to systems and methods for controlling engine coolant flow.

An internal combustion engine combusts air and fuel within cylinders to generate drive torque. Combustion of air and fuel also generates heat and exhaust. Exhaust produced by an engine flows through an exhaust system before being expelled to atmosphere.

Excessive heating may shorten the lifetime of the engine, engine components, and/or other components of a vehicle. As such, vehicles that include an internal combustion engine typically include a radiator that is connected to coolant channels within the engine. Engine coolant circulates through the coolant channels and the radiator. The engine coolant absorbs heat from the engine and carries the heat to the radiator. The radiator transfers heat from the engine coolant to air passing the radiator. The cooled engine coolant exiting the radiator is circulated back to the engine.

SUMMARY

In a feature, a coolant control system of a vehicle is described. A difference module is configured to: determine a block temperature difference based on a difference between a reference block temperature and a block temperature of an engine block measured using a block temperature sensor; determine a head temperature difference based on a difference between a reference head temperature and a head temperature of a cylinder head of the engine measured using a head temperature sensor; and determine a coolant outlet temperature difference based on a difference between a reference coolant outlet temperature and a temperature of coolant output from at least one of the engine block and the cylinder head measured using a coolant outlet temperature sensor. An opening module is configured to determine a coolant valve (CV) opening for a CV, a flow control valve (FCV) opening for a FCV, and a block valve (BV) opening for a BV based on at least one of the block temperature difference, the head temperature difference, and the coolant outlet temperature difference. A CV control module is configured to selectively actuate the CV based on the CV opening, where the CV regulates coolant flow from the FCV to (i) a radiator and (ii) a coolant channel bypassing the radiator. A BV control module is configured to selectively actuate the BV based on the BV opening, where the BV regulates coolant flow from the engine block to the FCV. A FCV control module is configured to selectively actuate the FCV based on the FCV opening, where the FCV regulates coolant flow from the cylinder head and the BV to the CV.

In further features, the opening module is configured to: based on the block temperature difference, determine a first possible CV opening, a first possible FCV opening, and a first possible BV opening; based on the head temperature difference, determine a second possible CV opening, a second possible FCV opening, and a second possible BV opening; based on the coolant outlet temperature difference, determine a third possible CV opening, a third possible FCV opening, and a third possible BV opening; set the CV opening for the CV to a maximum one of the first, second, and third possible CV openings; set the FCV opening for the FCV to a maximum one of the first, second, and third possible FCV openings; and set the BV opening for the BV to a maximum one of the first, second, and third possible BV openings.

In further features, the opening module is configured to increase the first possible CV opening, the first possible FCV opening, and the first possible BV opening as the block temperature becomes increasingly greater than the reference block temperature.

In further features, the opening module is configured to increase the second possible CV opening, the second possible FCV opening, and the second possible BV opening as the head temperature becomes increasingly greater than the reference head temperature.

In further features, the opening module is configured to increase the third possible CV opening, the third possible FCV opening, and the third possible BV opening as the coolant outlet temperature becomes increasingly greater than the reference coolant outlet temperature.

In further features: the CV control module is configured to increase an opening of the CV to the radiator as the CV opening increases; the BV control module is configured to increase an opening of the BV as the BV opening increases; and the FCV control module is configured to increase an opening of the FCV as the FCV opening increases.

In further features, the CV control module is further configured to decrease a second opening of the CV to the coolant channel bypassing the radiator as the CV opening increases.

In further features: a first maximum module is configured to set a CV opening command to a maximum one of: (i) the CV opening; and a second CV opening, where the CV control module is configured to actuate the CV based on the CV opening command; a second maximum module is configured to set a FCV opening command to a maximum one of: (i) the FCV opening; and a second FCV opening, where the FCV control module is configured to actuate the FCV based on the FCV opening command; and a third maximum module is configured to set a BV opening command to a maximum one of: (i) the BV opening; and a second BV opening, where the BV control module is configured to actuate the BV based on the BV opening command.

In further features, a reference module is configured to at least one of: determine the reference block temperature based on an engine speed of the engine and a fueling amount of the engine; determine the reference head temperature based on the engine speed and the fueling amount; and determine the reference coolant outlet temperature based on the engine speed and the fueling amount.

In further features, the reference module is configured to: determine the reference block temperature based on an engine speed of the engine and a fueling amount of the engine; determine the reference head temperature based on the engine speed and the fueling amount; and determine the reference coolant outlet temperature based on the engine speed and the fueling amount.

In a feature, a coolant control method of a vehicle includes: determining a block temperature difference based on a difference between a reference block temperature and a block temperature of an engine block measured using a block temperature sensor; determining a head temperature difference based on a difference between a reference head temperature and a head temperature of a cylinder head of the engine measured using a head temperature sensor; determining a coolant outlet temperature difference based on a difference between a reference coolant outlet temperature and a temperature of coolant output from at least one of the engine block and the cylinder head measured using a coolant outlet temperature sensor; determining a coolant valve (CV) opening for a CV, a flow control valve (FCV) opening for a FCV, and a block valve (BV) opening for a BV based on at least one of the block temperature difference, the head temperature difference, and the coolant outlet temperature difference; selectively actuating the CV based on the CV opening, where the CV regulates coolant flow from the FCV to (i) a radiator and (ii) a coolant channel bypassing the radiator; selectively actuating the BV based on the BV opening, where the BV regulates coolant flow from the engine block to the FCV; and selectively actuating the FCV based on the FCV opening, where the FCV regulates coolant flow from the cylinder head and the BV to the CV.

In further features, determining the coolant valve CV opening for the CV, the FCV opening for the FCV, and the BV opening for the BV includes: based on the block temperature difference, determining a first possible CV opening, a first possible FCV opening, and a first possible BV opening; based on the head temperature difference, determining a second possible CV opening, a second possible FCV opening, and a second possible BV opening; based on the coolant outlet temperature difference, determining a third possible CV opening, a third possible FCV opening, and a third possible BV opening; setting the CV opening for the CV to a maximum one of the first, second, and third possible CV openings; setting the FCV opening for the FCV to a maximum one of the first, second, and third possible FCV openings; and setting the BV opening for the BV to a maximum one of the first, second, and third possible BV openings.

In further features, determining the first possible CV opening, the first possible FCV opening, and the first possible BV opening includes increasing the first possible CV opening, the first possible FCV opening, and the first possible BV opening as the block temperature becomes increasingly greater than the reference block temperature.

In further features, determining the second possible CV opening, the second possible FCV opening, and the second possible BV opening includes increasing the second possible CV opening, the second possible FCV opening, and the second possible BV opening as the head temperature becomes increasingly greater than the reference head temperature.

In further features, determining the third possible CV opening, the third possible FCV opening, and the third possible BV opening includes increasing the third possible CV opening, the third possible FCV opening, and the third possible BV opening as the coolant outlet temperature becomes increasingly greater than the reference coolant outlet temperature.

In further features: selectively actuating the CV includes increasing an opening of the CV to the radiator as the CV opening increases; selectively actuating the BV includes increasing an opening of the BV as the BV opening increases; and selectively actuating the FCV control module includes increasing an opening of the FCV as the FCV opening increases.

In further features, selectively actuating the CV further decreasing a second opening of the CV to the coolant channel bypassing the radiator as the CV opening increases.

In further features, the method further includes: setting a CV opening command to a maximum one of: (i) the CV opening; and a second CV opening, where selectively actuating the CV includes actuating the CV based on the CV opening command; setting a FCV opening command to a maximum one of: (i) the FCV opening; and a second FCV opening, where selectively actuating the FCV includes actuating the FCV based on the FCV opening command; and setting a BV opening command to a maximum one of: (i) the BV opening; and a second BV opening, where selectively actuating the BV includes actuating the BV based on the BV opening command.

In further features, the method further includes at least one of: determining the reference block temperature based on an engine speed of the engine and a fueling amount of the engine; determining the reference head temperature based on the engine speed and the fueling amount; and determining the reference coolant outlet temperature based on the engine speed and the fueling amount.

In further features, the method further includes: determining the reference block temperature based on an engine speed of the engine and a fueling amount of the engine; determining the reference head temperature based on the engine speed and the fueling amount; and determining the reference coolant outlet temperature based on the engine speed and the fueling amount.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine combusts air and fuel to generate drive torque. Combustion generates heat. A coolant system circulates coolant through various portions of the engine, such as a cylinder head and an engine block, and through various other components of the vehicle. Coolant absorbs heat from the engine, engine oil, transmission fluid, and other components and releases heat to air.

Based on temperatures measured using temperature sensors, a coolant control module controls coolant flow (e.g., using valves, pumps, etc.) based on a target temperature that is close to a boiling temperature of the coolant. This may be done, for example, in an effort to minimize fuel consumption of the vehicle. Noise and/or errors in one or more of the measured temperatures, however, may allow the temperature of the coolant to exceed the boiling temperature.

According to the present disclosure, the coolant control module determines target openings for a plurality of valves of the coolant system to prevent over-temperature conditions from occurring. More specifically, the coolant control module collectively determines target openings for the valves, respectively, based on one or more temperature differences between measured and reference temperatures, respectively. If the target opening determined for one the valves is greater than the nominal target opening determined for that valve, the coolant control module controls opening of the one of the valves based on the target opening. The control module does this for each of the valves, for example, to prevent over-temperature conditions from occurring.

Figure 1:
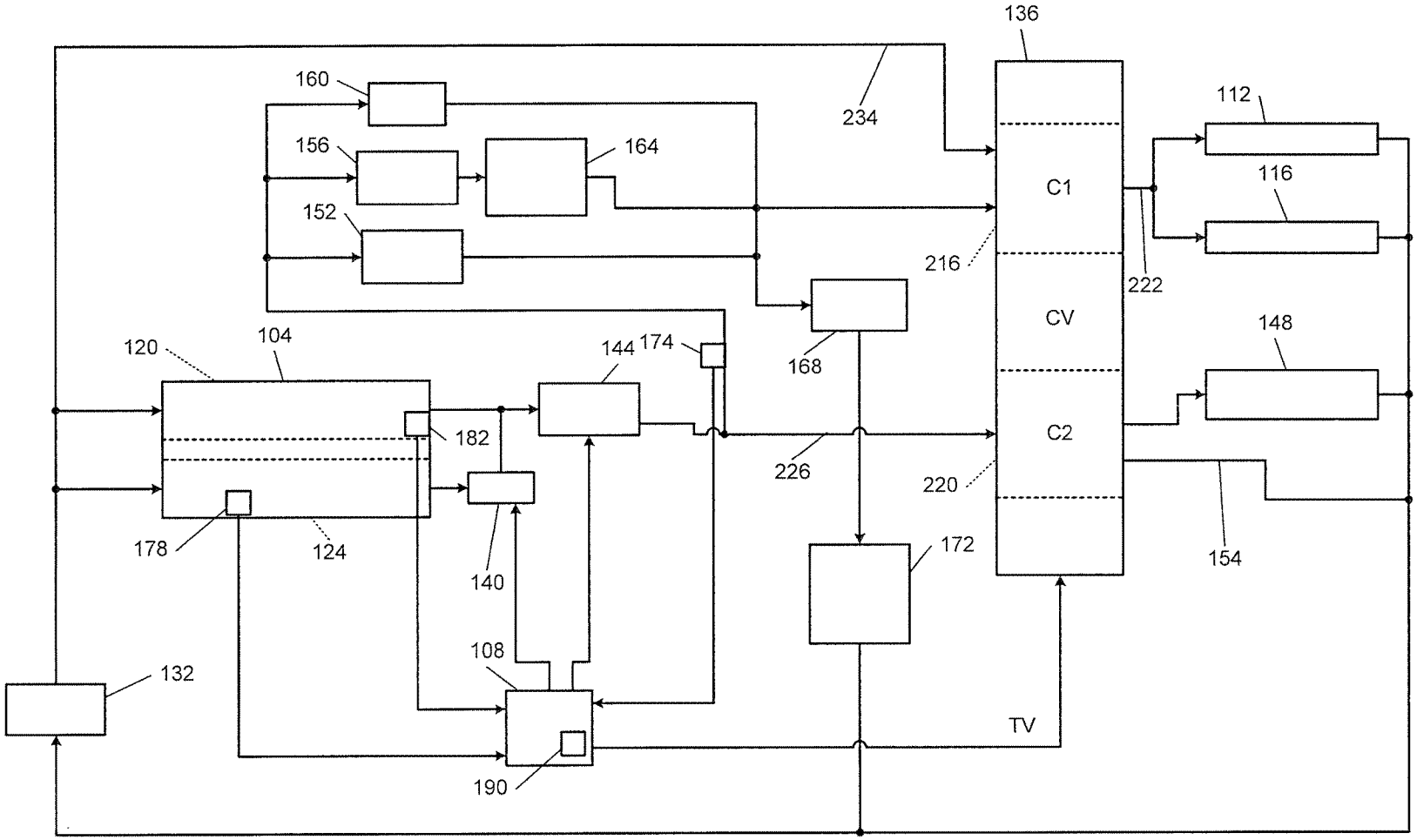
FIG. 1 is a functional block diagram of an example vehicle system including a coolant system.

Referring now to FIG. 1, a functional block diagram of an example vehicle system is presented. An engine 104 combusts a mixture of air and diesel fuel within cylinders to generate drive torque. The engine 104 outputs torque to a transmission. The transmission transfers torque to one or more wheels of a vehicle via a driveline (not shown). An engine control module (ECM) 108 may control one or more engine actuators to regulate the torque output of the engine 104, for example, based on a target torque output of the engine 104.

An engine oil pump circulates engine oil through the engine 104 and a first heat exchanger 112. The first heat exchanger 112 may be referred to as an (engine) oil cooler or an oil heat exchanger (HEX). When the engine oil is cold, the first heat exchanger 112 may transfer heat to engine oil within the first heat exchanger 112 from coolant flowing through the first heat exchanger 112. When the engine oil is warm, the first heat exchanger 112 may transfer heat from the engine oil to coolant flowing through the first heat exchanger 112 and/or to air passing the first heat exchanger 112.

Viscosity of the engine oil is inversely related to temperature of the engine oil. That is, viscosity of the engine oil decreases as the temperature increases and vice versa. Frictional losses (e.g., torque losses) of the engine 104 associated with the engine oil may decrease as viscosity of the engine oil decreases and vice versa.

A transmission fluid pump circulates transmission fluid through the transmission and a second heat exchanger 116. The second heat exchanger 116 may be referred to as a transmission cooler or as a transmission heat exchanger. When the transmission fluid is cold, the second heat exchanger 116 may transfer heat to transmission fluid within the second heat exchanger 116 from coolant flowing through the second heat exchanger 116. When the transmission fluid is warm, the second heat exchanger 116 may transfer heat from the transmission fluid to coolant flowing through the second heat exchanger 116 and/or to air passing the second heat exchanger 116.

Viscosity of the transmission fluid is inversely related to temperature of the transmission fluid. That is, viscosity of the transmission fluid decreases as the temperature of the transmission fluid increases and vice versa. Losses (e.g., torque losses) associated with the transmission and the transmission fluid may decrease as viscosity of the transmission fluid decreases and vice versa.

The engine 104 includes a plurality of coolant channels through which engine coolant ("coolant") can flow. For example, the engine 104 includes one or more coolant channels through the (cylinder) head portion 120 of the engine 104 and one or more coolant channels through the block portion 124 of the engine 104. The engine 104 may also include one or more other coolant channels through one or more other portions of the engine 104.

A coolant pump 132 pumps coolant to the coolant channels of the engine 104 and to a coolant valve (CV) 136. The coolant pump 132 may be mechanically driven (e.g., by the engine 104). Alternatively, the coolant pump 132 may be an electric coolant pump. The CV 136 is discussed further below.

A block valve (BV) 140 regulates coolant flow out of (and therefore through) the block portion 124 of the engine 104. A flow control valve (FCV) 144 receives coolant output from the head portion 120 of the engine 104, coolant output from the BV 140. The FCV 144 regulates coolant flow out of (and therefore through) the head portion 120 of the engine 104. By way of its receiving coolant from the BV 140, the FCV 144 also regulates coolant flow out of (and therefore through) the block portion 124 of the engine 104.

The CV 136 may be referred to as an active thermostat valve. Unlike passive thermostat valves which automatically open and close when a coolant temperature is greater than and less than a predetermined temperature, respectively, active thermostat valves are electrically actuated.

The CV 136 controls coolant flow to a third heat exchanger 148, coolant flow bypassing the third heat exchanger 148, and coolant flow to the first and second heat exchangers 112 and 116. The third heat exchanger 148 may be referred to as a radiator. The CV 136 is discussed further below.

Coolant flows from the FCV 144 to the CV 136. Coolant also flows from the FCV 144 to a low pressure (LP) exhaust gas recirculation (EGR) heat exchanger 152, a high pressure (HP) EGR heat exchanger 156, and a turbocharger turbine 160. Coolant flows from the HP EGR heat exchanger 156 to an exhaust (EX) throttle valve 164. Coolant may cool the LP EGR heat exchanger 152, the HP EGR heat exchanger 156, the turbocharger turbine 160, and the exhaust throttle valve 164. The turbocharger turbine 160 drives rotation of a turbocharger compressor which increases airflow into the engine. Exhaust output by the engine 104 drives rotation of the turbocharger turbine 160.

Coolant flows from the turbocharger turbine 160, the exhaust throttle valve 164, and the LP EGR heat exchanger 152 to the CV 136 and to a fourth heat exchanger 168, which may be referred to as a heater core. The fourth heat exchanger 168 transfers heat from coolant flowing through the fourth heat exchanger 168 to air passing the fourth heat exchanger 168 to warm a passenger cabin of the vehicle. An auxiliary coolant pump 172 may also be implemented to draw coolant through the fourth heat exchanger 168 and to pump coolant back to the coolant pump 132. The coolant pump 132 draws coolant output by the first heat exchanger 112, coolant output by the second heat exchanger 116, coolant output by the third heat exchanger 148, coolant bypassing the third heat exchanger 148, and coolant output by fourth heat exchanger 168 for recirculation.

A coolant outlet temperature sensor 174 measures a temperature of coolant output from the FCV 144. A block temperature sensor 178 measures a temperature of the block (metal) portion 124 of the engine 104. A head temperature sensor 182 measures a temperature of the head (metal) portion 120 of the engine 104. One or more other sensors may also be implemented, such as one or more other coolant temperature sensors, a crankshaft position sensor, a mass air flowrate (MAF) sensor, a manifold absolute pressure (MAP) sensor, and/or one or more other suitable vehicle sensors.

The CV 136 may include a multiple-input, multiple-output valve that includes two or more separate chambers. For example, the CV 136 may include a rotary valve having a housing and a rotatable member inside of the housing. The rotating member includes channels or grooves that, for each of the separate chambers, regulate flow between one or more inputs of that chamber and one or more outputs of that chamber.

Figure 2:
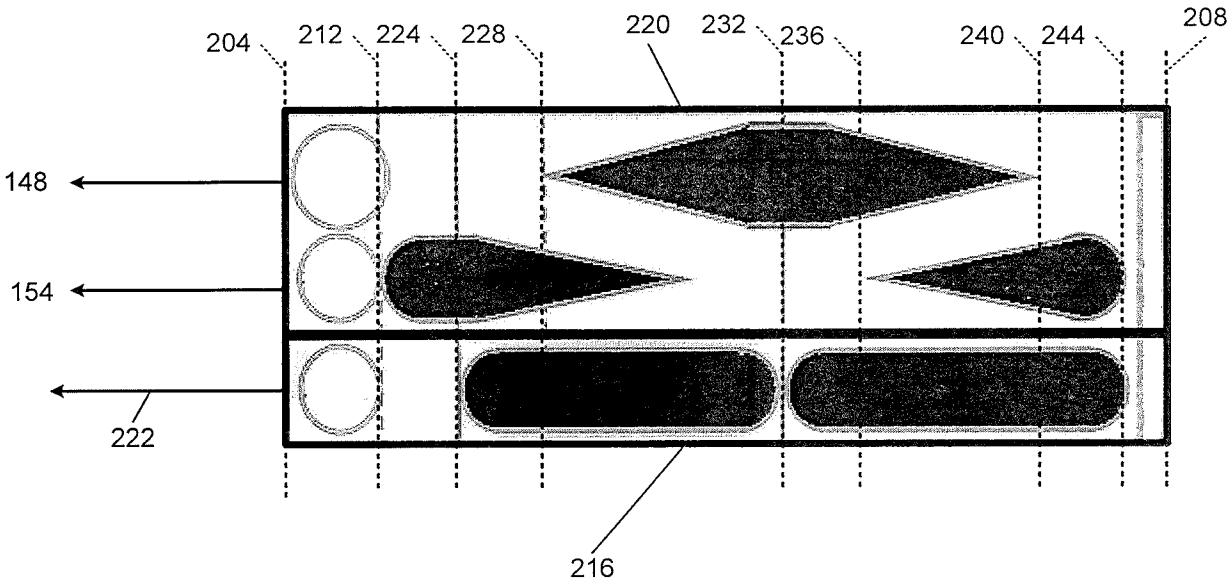
FIG. 2 is an example laid-flat view of a rotary coolant valve.

An example laid flat diagram of the CV 136 illustrating coolant flow to and from the CV 136 is provided in FIG. 2. Referring now to FIGS. 1 and 2, the CV 136 can be actuated between two end positions 204 and 208. The CV 136 includes a first chamber 216 and a second chamber 220. When the CV 136 is positioned between the end position 204 and a first position 212, coolant flow into the first chamber 216 is blocked, and coolant flow into the second chamber 220 is blocked.

When the first chamber 216 is receiving coolant, the CV 136 outputs coolant from the first chamber 216 to the first heat exchanger 112 and the second heat exchanger 116 via a coolant channel 222. When the second chamber 220 is receiving coolant, the CV 136 outputs coolant from the second chamber 220 to the third heat exchanger 148 or to a coolant channel 154 bypassing the third heat exchanger 148.

When the CV 136 is positioned between the first position 212 and a second position 224, coolant flow into the first chamber 216 is blocked and coolant output by the FCV 144 flows into the second chamber 220 via a coolant channel 226. When the CV 136 is positioned between the first position 212 and the second position 224, coolant flows from the second chamber 220 to the coolant channel 154 bypassing the third heat exchanger 148, as shown by the teardrop shaped portion. Coolant flow from the second chamber 220 to the third heat exchanger 148, however, is blocked.

When the CV 136 is positioned between the second position 224 and a third position 228, coolant output by the turbocharger turbine 160, the exhaust throttle valve 164, and the LP EGR heat exchanger 152 flows into the first one of the chambers 216. Coolant flows from the first chamber 216 to the first and second heat exchangers 112 and 116. Coolant flow into the first chamber 216 from the coolant pump 132, however, is blocked.

When the CV 136 is positioned between the second position 224 and the third position 228, coolant output by the FCV 144 flows into the second chamber 220. When the CV 136 is positioned between the second position 224 and the third position 228, coolant flows from the second chamber 220 to the coolant channel 154 bypassing the third heat exchanger 148. Coolant flow from the second chamber 220 to the third heat exchanger 148, however, is blocked.

When the CV 136 is positioned between the third position 228 and a fourth position 232, coolant output by the turbocharger turbine 160, the exhaust throttle valve 164, and the LP EGR heat exchanger 152 flows into the first one of the chambers 216 and to the first and second heat exchangers 112 and 116. Coolant flow into the first chamber 216 from the coolant pump 132, however, is blocked.

When the CV 136 is positioned between the third position 228 and the fourth position 232, some coolant flows from the second chamber 220 to the coolant channel 154 bypassing the third heat exchanger 148. Some coolant also flows from the second chamber 220 to the third heat exchanger 148 when the CV 136 is positioned between the third position 228 and the fourth position 232, as indicated by the diamond like shape. At positions between the end of the point of the tear drop shape and the fourth position 232, however, coolant flow to the coolant channel 154 bypassing the third heat exchanger 148 is blocked.

When the CV 136 is positioned between the fourth position 232 and a fifth position 236, coolant output by the coolant pump 132 flows into the first chamber 216 and to the first and second heat exchangers 112 and 116. Coolant flow from the turbocharger turbine 160, the exhaust throttle valve 164, and the LP EGR heat exchanger 152, however, is blocked.

When the CV 136 is positioned between the fourth position 232 and the fifth position 236, coolant flows from the second chamber 220 to the third heat exchanger 148, as indicated by the diamond shape. However, coolant flow to the coolant channel 154 bypassing the third heat exchanger 148 is blocked.

When the CV 136 is positioned between the fifth position 236 and a sixth position 240, coolant output by the coolant pump 132 via coolant path 234 flows into the first chamber 216 and to the first and second heat exchangers 112 and 116. Coolant flow from the turbocharger turbine 160, the exhaust throttle valve 164, and the LP EGR heat exchanger 152, however, is blocked.

When the CV 136 is positioned between the fifth position 236 and the sixth position 240, coolant flows from the second chamber 220 to the third heat exchanger 148, as indicated by the diamond like shape. Coolant also flows from the second chamber 220 to the coolant channel 154 bypassing the third heat exchanger 148, as indicated by the teardrop shaped portion.

When the CV 136 is positioned between the sixth position 240 and a seventh position 244, coolant output by the coolant pump 132 via the coolant path 234 flows into the first chamber 216 and to the first and second heat exchangers 112 and 116. Coolant flow from the turbocharger turbine 160, the exhaust throttle valve 164, and the LP EGR heat exchanger 152, however, is blocked.

When the CV 136 is positioned between the sixth position 240 and the seventh position 244, coolant flows from the second chamber 220 to the coolant channel 154 bypassing the third heat exchanger 148, as indicated by the teardrop shape. Coolant flow to the third heat exchanger 148, however, is blocked.

Figure 3:
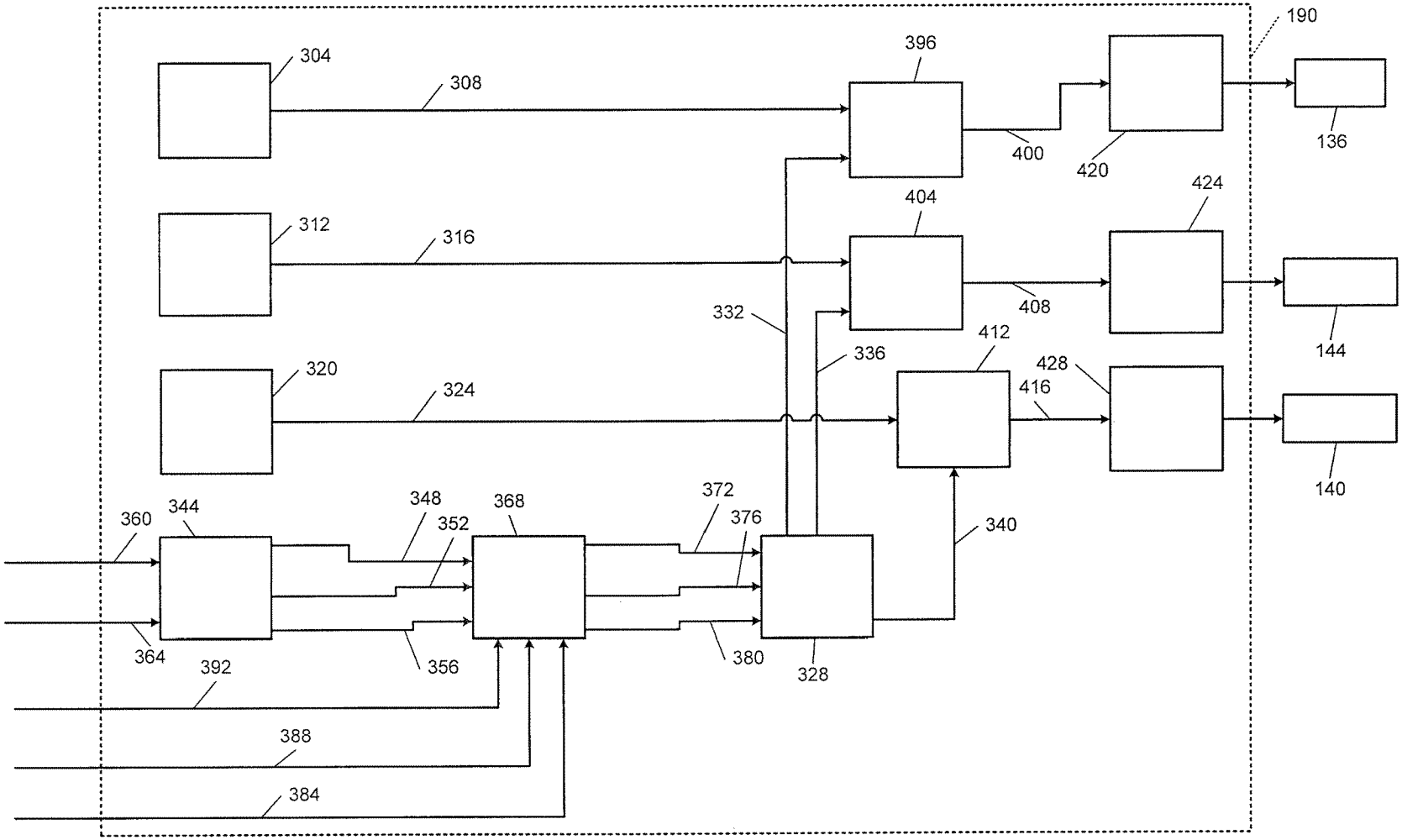
FIG. 3 is a functional block diagram of an example coolant control module.

Referring now to FIG. 3, a functional block diagram of an example implementation of a coolant control module 190 is presented. A first CV opening module 304 determines a first CV opening 308 for the CV 136. For example, the first CV opening module 304 may determine the first CV opening 308 based on coolant pump outlet/engine inlet coolant temperature measured at or near the outlet of the coolant pump 132. For example, the first CV opening module 304 may determine the first CV opening 308 based on regulating the coolant pump outlet coolant temperature based on a target temperature at the outlet of the coolant pump 132 using closed loop control.

A first FCV opening module 312 determines a first FCV opening 316 for the FCV 144. For example, the first FCV opening module 312 may determine the first FCV opening 316 based on the coolant pump outlet coolant temperature measured at or near the outlet of the coolant pump 132. The first FCV opening module 312 may determine the first FCV opening 316, for example, using an equation or a lookup table that relates coolant pump outlet coolant temperatures to first FCV openings. The equation or lookup table may be calibrated based on preventing boiling of coolant in the head portion 120 of the engine, the LP EGR heat exchanger 152, the HP EGR heat exchanger 156, the exhaust throttle valve 164, and the turbocharger turbine 160.

A first BV opening module 320 determines a first BV opening 324 for the BV 140. For example, the first BV opening module 320 may determine the first BV opening 324 based on the coolant pump outlet coolant temperature measured at or near the outlet of the coolant pump 132. The first BV opening module 320 may determine the first BV opening 324, for example, using an equation or a lookup table that relates coolant pump outlet coolant temperatures to first BV openings. The equation or lookup table may be calibrated based on preventing boiling of coolant in the block portion 124 of the engine.

Under some circumstances, however, use the first CV opening 308, the first FCV opening 316, and the first BV opening 324 may not prevent an over-temperature condition from occurring at one or more locations. A second opening module 328 therefore determines a second CV opening 332, a second FCV opening 336, and a second BV opening 340, as discussed below, to minimize the possibility of occurrence of an over-temperature condition.

A reference module 344 determines a reference block temperature 348, a reference head temperature 352, and a reference coolant outlet temperature 356 based on an engine speed 360 and fueling 364 of the engine 104. For example, the reference module 344 may determine the reference block temperature 348 using one of an equation and a mapping that relates engine speeds and fueling amounts to reference block temperatures. The reference module 344 may determine the reference head temperature 352 using one of an equation and a mapping that relates engine speeds and fueling amounts to reference head temperatures. The reference module 344 may determine the reference coolant outlet temperature 356 using one of an equation and a mapping that relates engine speeds and fueling amounts to reference coolant outlet temperatures.

The engine speed 360 may be measured using a sensor. For example, a crankshaft position sensor may determine positions of a crankshaft of the engine 104 as the crankshaft rotates, and the engine speed 360 may be measured based on a change between two positions and the period between when the crankshaft was in the two positions. The fueling 364 may be, for example, a commanded mass of fuel provided to a cylinder the engine 104. A fuel control module of the vehicle may provide the fueling 364.

A difference module 368 determines a block temperature difference 372, a head temperature difference 376, and an outlet temperature difference 380. The difference module 368 sets the block temperature difference 372 based on or equal to a difference between the reference block temperature 348 and a block temperature 384 measured by the block temperature sensor 178. For example, the difference module 368 may set the block temperature difference 372 based on or equal to the block temperature 384 minus the reference block temperature 348.

The difference module 368 sets the head temperature difference 376 based on or equal to a difference between the reference head temperature 352 and a head temperature 388 measured by the head temperature sensor 182. For example, the difference module 368 may set the head temperature difference 376 based on or equal to the head temperature 388 minus the reference head temperature 352.

The difference module 368 sets the outlet temperature difference 380 based on or equal to a difference between the reference coolant outlet temperature 356 and a coolant outlet temperature 392 measured by the coolant outlet temperature sensor 174. For example, the difference module 368 may set the outlet temperature difference 380 based on or equal to the coolant outlet temperature 392 minus the reference coolant outlet temperature 356.

The second opening module 328 determines the second CV opening 332, the second FCV opening 336, and the second BV opening 340 based on at least one of the block temperature difference 372, the head temperature difference 376, and the outlet temperature difference 380.

For example, the second opening module 328 may determine a first set of possible openings based on the outlet temperature difference 380. The first set of possible openings includes a first possible CV opening, a first possible FCV opening, and a first possible BV opening. The second opening module 328 determines the first set of possible openings based on the outlet temperature difference 380 using a lookup table that relates outlet temperature differences to sets of CV openings, FCV openings, and BV openings. An example lookup table relating outlet temperature differences to sets of CV, FCV, and BV openings is provided below. The CV opening is expressed in terms of opening to the third heat exchanger 148. The outlet temperature difference is expressed in terms of coolant outlet temperature minus reference coolant outlet temperature such that negative coolant outlet temperatures correspond to the coolant outlet temperature being less than the reference coolant outlet temperature.

| Outlet Temp Difference | FCV opening (%) | CV Opening (%) | BV Opening (%) |
|---|---|---|---|
| −6 | 0 | 0 | 0 |
| −4 | 20 | 20 | 0 |
| −2 | 35 | 35 | 0 |
| 0 | 50 | 50 | 0 |
| 2 | 70 | 60 | 20 |
| 4 | 90 | 70 | 40 |
| 6 | 100 | 80 | 60 |
| 8 | 100 | 90 | 80 |
| 10 | 100 | 100 | 100 |

As shown above, the possible openings of the CV 136, the FCV 144, and the BV 140 increase as the coolant temperature difference increases. Thus, in the case of the BV 140 and the FCV 144, flow increases. In the case of the CV 136, additional coolant flows to the third heat exchanger 148. These actions are taken to provide additional cooling to prevent an over temperature condition from occurring.

As shown above with respect to FIG. 2, due to the configuration of the CV 136, two different positions of the CV 136 may provide the same opening to the third heat exchanger 148. Which one of the two positions to use may be determined based on whether coolant flow to the coolant channel 154 bypassing the third heat exchanger 148 is to occur or be blocked and/or based on whether the first chamber 216 is to receive coolant output from the coolant pump 132 or from the output of the turbocharger turbine 160, etc.

The second opening module 328 may determine a second set of possible openings based on the block temperature difference 372. The second set of possible openings includes a second possible CV opening, a second possible FCV opening, and a second possible BV opening. The second opening module 328 determines the second set of possible openings based on the block temperature difference 372 using a lookup table that relates block temperature differences to sets of CV openings, FCV openings, and BV openings. This lookup table may be arranged similarly to the lookup table provided above regarding the coolant outlet temperature difference. This lookup table, however, may include one or more different values.

The second opening module 328 may determine a third set of possible openings based on the head temperature difference 376. The third set of possible openings includes a third possible CV opening, a third possible FCV opening, and a third possible BV opening. The second opening module 328 determines the third set of possible openings based on the head temperature difference 376 using a lookup table that relates head temperature differences to sets of CV openings, FCV openings, and BV openings. This lookup table may be arranged similarly to the lookup table provided above regarding the coolant outlet temperature difference. This lookup table, however, may include one or more different values.

The second opening module 328 determines a maximum (largest) one of the first, second, and third possible CV openings and sets the second CV opening 332 to the maximum one of the first, second, and third possible CV openings. The second opening module 328 determines a maximum (largest) one of the first, second, and third possible FCV openings and sets the second FCV opening 336 to the maximum one of the first, second, and third possible FCV openings. The second opening module 328 determines a maximum (largest) one of the first, second, and third possible BV openings and sets the second BV opening 340 to the maximum one of the first, second, and third possible BV openings.

A first maximum module 396 determines a maximum (largest) one of the first CV opening 308 and the second CV opening 332 and sets a commanded CV opening 400 (to the third heat exchanger 148) to the maximum one of the first CV opening 308 and the second CV opening 332. A second maximum module 404 determines a maximum (largest) one of the first FCV opening 316 and the second FCV opening 336 and sets a commanded FCV opening 408 to the maximum one of the first FCV opening 316 and the second FCV opening 336. A third maximum module 412 determines a maximum (largest) one of the first BV opening 324 and the second BV opening 340 and sets a commanded BV opening 416 to the maximum one of the first BV opening 324 and the second BV opening 340.

A CV control module 420 actuates the CV 136 based on the commanded CV opening 400. A FCV control module 424 actuates the FCV 144 based on the commanded FCV opening 408. A BV control module 428 actuates the BV 140 based on the commanded BV opening 416. Use of the second CV opening 332, the second FCV opening 336, and/or the second BV opening 340 may reduce a possibility of occurrence of an over temperature condition.

Figure 4:
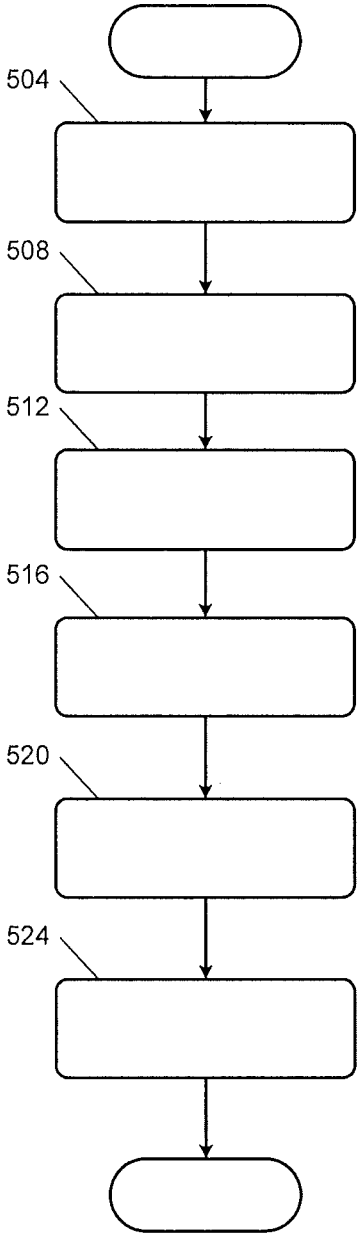
FIG. 4 is a flowchart depicting an example method of controlling coolant flow.

FIG. 4 is a flowchart depicting an example method of controlling coolant flow to prevent an over temperature condition from occurring. Control begins with 504 where the first CV opening module 304, the first FCV opening module 312, and the first BV opening module 320 determine the first CV opening 308, the first FCV opening 316, and the first BV opening 324, respectively.

At 508, the reference module 344 determines the reference block temperature 348, the reference head temperature 352, and the reference coolant outlet temperature 356. The reference module 344 determines these reference temperatures based on the engine speed 360 and the fueling 364 of the engine 104.

The difference module 368 determines the block temperature difference 372, the head temperature difference 376, and the outlet temperature difference 380 at 512. The difference module 368 determines the block temperature difference 372 based on a difference between the block temperature 384 and the reference block temperature 348. The difference module 368 determines the head temperature difference 376 based on a difference between the head temperature 388 and the reference head temperature 352. The difference module 368 determines the outlet temperature difference 380 based on a difference between the coolant outlet temperature 392 and the reference coolant outlet temperature 356.

At 516, the second opening module 328 determines the second CV opening 332, the second FCV opening 336, and the second BV opening 340. More specifically, the second opening module 328 determines a first set of possible CV, FCV, and BV openings based on the block temperature difference 372. The second opening module 328 determines a second set of possible CV, FCV, and BV openings based on the head temperature difference 376. The second opening module 328 determines a third set of possible CV, FCV, and BV openings based on the outlet temperature difference 380.

The second opening module 328 determines a maximum (largest) one of the possible CV openings from the first, second, and third sets and sets the second CV opening 332 to the maximum one of the possible CV openings. The second opening module 328 determines a maximum (largest) one of the possible FCV openings from the first, second, and third sets and sets the second FCV opening 336 to the maximum one of the possible FCV openings. The second opening module 328 determines a maximum (largest) one of the possible BV openings from the first, second, and third sets and sets the second BV opening 340 to the maximum one of the possible BV openings.

At 520, the first, second, and third maximum modules 396, 404, and 412 generate the commanded CV, FCV, and BV openings 400, 408, and 416, respectively. The first maximum module 396 determines a maximum (largest) one of the first and second CV openings 308 and 332 and sets the commanded CV opening 400 to the maximum one of the first and second CV opening 308 and 332. The second maximum module 404 determines a maximum (largest) one of the first and second FCV openings 316 and 336 and sets the commanded FCV opening 408 to the maximum one of the first and second FCV opening 316 and 336. The third maximum module 412 determines a maximum (largest) one of the first and second BV openings 324 and 340 and sets the commanded BV opening 416 to the maximum one of the first and second BV opening 324 and 340.

At 524, the CV, FCV, and BV control modules 420, 424, and 428 control the CV 136, the FCV 144, and the BV 140 based on the commanded CV, FCV, and BV openings 400, 408, and 416, respectively. For example, the CV control module 420 may determine a position for the CV 136 based on the commanded CV opening 400 and actuate the CV 136 to the position. The CV control module 420 may determine the position, for example, using an equation or a lookup table that relates commanded CV openings to positions of the CV 136. The FCV control module 424 may determine a position for the FCV 144 based on the commanded FCV opening 408 and actuate the FCV 144 to the position. The FCV control module 424 may determine the position, for example, using an equation or a lookup table that relates commanded FCV openings to positions of the FCV 144. The BV control module 428 may determine a position for the BV 140 based on the commanded BV opening 416 and actuate the BV 140 to the position. The BV control module 428 may determine the position, for example, using an equation or a lookup table that relates commanded BV openings to positions of the BV 140. While the example of FIG. 4 is shown as ending, FIG. 4 is illustrative of one control loop. Control loops may be initiated every predetermined period.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP:

Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A coolant control system of a vehicle, comprising:

a difference module configured to:

determine a block temperature difference based on a difference between a reference block temperature and a block temperature of an engine block measured using a block temperature sensor;

determine a head temperature difference based on a difference between a reference head temperature and a head temperature of a cylinder head of the engine measured using a head temperature sensor; and determine a coolant outlet temperature difference based on a difference between a reference coolant outlet temperature and a temperature of coolant output from at least one of the engine block and the cylinder head measured using a coolant outlet temperature sensor;

an opening module configured to determine a coolant valve (CV) opening for a CV, a flow control valve (FCV) opening for a FCV, and a block valve (BV) opening for a BV based on at least one of the block temperature difference, the head temperature difference, and the coolant outlet temperature difference;

a CV control module configured to selectively actuate the CV based on the CV opening, wherein the CV regulates coolant flow from the FCV to (i) a radiator and (ii) a coolant channel bypassing the radiator before the coolant flows back the engine;

a BV control module configured to selectively actuate the BV based on the BV opening, wherein the BV regulates coolant flow from the engine block to the FCV; and a FCV control module configured to selectively actuate the FCV based on the FCV opening, wherein the FCV regulates coolant flow from the cylinder head and the BV to the CV.

2. The coolant control system of claim 1 wherein the opening module is configured to:

based on the block temperature difference, determine a first possible CV opening, a first possible FCV opening, and a first possible BV opening;

based on the head temperature difference, determine a second possible CV opening, a second possible FCV opening, and a second possible BV opening;

based on the coolant outlet temperature difference, determine a third possible CV opening, a third possible FCV opening, and a third possible BV opening;

set the CV opening for the CV to a maximum one of the first, second, and third possible CV openings;

set the FCV opening for the FCV to a maximum one of the first, second, and third possible FCV openings; and set the BV opening for the BV to a maximum one of the first, second, and third possible BV openings.

3. The coolant control system of claim 2 wherein the opening module is configured to increase the first possible CV opening, the first possible FCV opening, and the first possible BV opening as the block temperature becomes increasingly greater than the reference block temperature.

4. The coolant control system of claim 2 wherein the opening module is configured to increase the second possible CV opening, the second possible FCV opening, and the second possible BV opening as the head temperature becomes increasingly greater than the reference head temperature.

5. The coolant control system of claim 2 wherein the opening module is configured to increase the third possible CV opening, the third possible FCV opening, and the third possible BV opening as the coolant output temperature becomes increasingly greater than the reference coolant outlet temperature.

6. The coolant control system of claim 1 wherein:

the CV control module is configured to increase an opening of the CV to the radiator as the CV opening increases;

the BV control module is configured to increase an opening of the BV as the BV opening increases; and the FCV control module is configured to increase an opening of the FCV as the FCV opening increases.

7. The coolant control system of claim 6 wherein the CV control module is further configured to decrease a second opening of the CV to the coolant channel bypassing the radiator as the CV opening increases.

8. The coolant control system of claim 1 further comprising:

a first maximum module configured to set a CV opening command to a maximum one of: (i) the CV opening; and a second CV opening, wherein the CV control module is configured to actuate the CV based on the CV opening command;

a second maximum module configured to set a FCV opening command to a maximum one of: (i) the FCV opening; and a second FCV opening, wherein the FCV control module is configured to actuate the FCV based on the FCV opening command; and a third maximum module configured to set a BV opening command to a maximum one of: (i) the BV opening; and a second BV opening, wherein the BV control module is configured to actuate the BV based on the BV opening command.

9. The coolant control system of claim 1 further comprising a reference module configured to at least one of:

determine the reference block temperature based on an engine speed of the engine and a fueling amount of the engine;

determine the reference head temperature based on the engine speed and the fueling amount; and determine the reference coolant outlet temperature based on the engine speed and the fueling amount.

10. The coolant control system of claim 9 wherein the reference module is configured to:

determine the reference block temperature based on an engine speed of the engine and a fueling amount of the engine;

determine the reference head temperature based on the engine speed and the fueling amount; and determine the reference coolant outlet temperature based on the engine speed and the fueling amount.

11. A coolant control method of a vehicle, comprising:

determining a block temperature difference based on a difference between a reference block temperature and a block temperature of an engine block measured using a block temperature sensor;

determining a head temperature difference based on a difference between a reference head temperature and a head temperature of a cylinder head of the engine measured using a head temperature sensor;

determining a coolant outlet temperature difference based on a difference between a reference coolant outlet temperature and a temperature of coolant output from at least one of the engine block and the cylinder head measured using a coolant outlet temperature sensor;

determining a coolant valve (CV) opening for a CV, a flow control valve (FCV) opening for a FCV, and a block valve (BV) opening for a BV based on at least one of the block temperature difference, the head temperature difference, and the coolant outlet temperature difference;

selectively actuating the CV based on the CV opening, wherein the CV regulates coolant flow from the FCV to (i) a radiator and (ii) a coolant channel bypassing the radiator before the coolant flows back the engine;

selectively actuating the BV based on the BV opening, wherein the BV regulates coolant flow from the engine block to the FCV; and selectively actuating the FCV based on the FCV opening, wherein the FCV regulates coolant flow from the cylinder head and the BV to the CV.

12. The coolant control method of claim 11 wherein determining the coolant valve CV opening for the CV, the FCV opening for the FCV, and the BV opening for the BV includes:

based on the block temperature difference, determining a first possible CV opening, a first possible FCV opening, and a first possible BV opening;

based on the head temperature difference, determining a second possible CV opening, a second possible FCV opening, and a second possible BV opening;

based on the coolant outlet temperature difference, determining a third possible CV opening, a third possible FCV opening, and a third possible BV opening;

setting the CV opening for the CV to a maximum one of the first, second, and third possible CV openings;

setting the FCV opening for the FCV to a maximum one of the first, second, and third possible FCV openings; and setting the BV opening for the BV to a maximum one of the first, second, and third possible BV openings.

13. The coolant control method of claim 12 wherein determining the first possible CV opening, the first possible FCV opening, and the first possible BV opening includes increasing the first possible CV opening, the first possible FCV opening, and the first possible BV opening as the block temperature becomes increasingly greater than the reference block temperature.

14. The coolant control method of claim 12 wherein determining the second possible CV opening, the second possible FCV opening, and the second possible BV opening includes increasing the second possible CV opening, the second possible FCV opening, and the second possible BV opening as the head temperature becomes increasingly greater than the reference head temperature.

15. The coolant control method of claim 12 wherein determining the third possible CV opening, the third possible FCV opening, and the third possible BV opening includes increasing the third possible CV opening, the third possible FCV opening, and the third possible BV opening as the coolant output temperature becomes increasingly greater than the reference coolant outlet temperature.

16. The coolant control method of claim 11 wherein:

selectively actuating the CV includes increasing an opening of the CV to the radiator as the CV opening increases;

selectively actuating the BV includes increasing an opening of the BV as the BV opening increases; and selectively actuating the FCV includes increasing an opening of the FCV as the FCV opening increases.

17. The coolant control method of claim 16 selectively actuating the CV further decreasing a second opening of the CV to the coolant channel bypassing the radiator as the CV opening increases.

18. The coolant control method of claim 11 further comprising:

setting a CV opening command to a maximum one of: (i) the CV opening; and a second CV opening, wherein selectively actuating the CV includes actuating the CV based on the CV opening command;

setting a FCV opening command to a maximum one of: (i) the FCV opening; and a second FCV opening, wherein selectively actuating the FCV includes actuating the FCV based on the FCV opening command; and setting a BV opening command to a maximum one of: (i) the BV opening; and a second BV opening, wherein selectively actuating the BV includes actuating the BV based on the BV opening command.

19. The coolant control method of claim 11 further comprising at least one of:

determining the reference block temperature based on an engine speed of the engine and a fueling amount of the engine;

determining the reference head temperature based on the engine speed and the fueling amount; and determining the reference coolant outlet temperature based on the engine speed and the fueling amount.

20. The coolant control method of claim 11 further comprising:

determining the reference block temperature based on an engine speed of the engine and a fueling amount of the engine;

determining the reference head temperature based on the engine speed and the fueling amount; and determining the reference coolant outlet temperature based on the engine speed and the fueling amount.

* * * * *